United States Patent [19]

Fitton

[11] Patent Number: 4,875,567

[45] Date of Patent: Oct. 24, 1989

[54] COIN VALIDATION DEVICE

[75] Inventor: Stephen Fitton, Firwood Park, United Kingdom

[73] Assignee: Neo Electronics Limited, Oldham, United Kingdom

[21] Appl. No.: 76,208

[22] PCT Filed: Oct. 24, 1986

[86] PCT No.: PCT/GB86/00658

§ 371 Date: Aug. 17, 1987

§ 102(e) Date: Aug. 17, 1987

[87] PCT Pub. No.: WO87/02809

PCT Pub. Date: May 7, 1987

[30] Foreign Application Priority Data

Oct. 30, 1985 [GB] United Kingdom ..... 8526686

[51] Int. Cl.[4] ..... G07D 5/08

[52] U.S. Cl. ..... 194/318; 324/234

[58] Field of Search ..... 194/317, 318, 319; 324/228, 234, 236, 239

[56] References Cited

U.S. PATENT DOCUMENTS 3,952,851 4/1976 Fougere et al. ..... 194/317
4,105,105 8/1978 Braum ..... 194/346 X
4,353,452 10/1982 Shah et al. ..... 194/317
4,371,073 2/1983 Dubey ..... 194/334

FOREIGN PATENT DOCUMENTS 2014023 10/1971 Fed. Rep. of Germany .
2161799 7/1973 Fed. Rep. of Germany .
2144519 2/1973 France .
2212589 7/1974 France .
1403103 8/1975 United Kingdom .
2086633 5/1982 United Kingdom .

*Primary Examiner*—F. J. Bartuska
*Attorney, Agent, or Firm*—Spensley Horn Jubas & Lubitz

[57] ABSTRACT

A coin validation device includes a channel which defines a first axis. A pair of magnetic cores is located on opposite sides of the channel. The cores are substantially the same size and each is E-shaped so as to define a central leg and two outer legs extending towards the corresponding legs of the other core in a direction substantially parallel to a second axis. The central leg of one core supports an exciting coil. The central leg of the other core supports a detector coil. The outer legs of each core are spaced apart in a direction perpendicular to the length of the channel along a third axis. The first, second and third axis are mutually perpendicular.

8 Claims, 3 Drawing Sheets

COIN VALIDATION DEVICE

The present invention relates toa coin validation device.

Various coin validation devices are known which are used for example in a vending machine to identify a coin deposited by a user and enable operation of the vending machine in accordance with the identity of the coin. Earlier forms of validation device were mechanical but more recent designs have relied upon magnetic sensors to detect and identify deposited coins.

In one known arrangement as described in British Patent No. 1 265 361 deposited coins are caused to move along a channel through a gap in a magnetic circuit which is a component part of a magnetic bridge. Genuine coins were previously positioned in the same limb of the bridge and the magnetic response was recorded. The magnetic effect of a deposited coin and of a geniune coin can then be compared.

Thus, it is well known that the use of a magnetic sensor enables an output signal to be generated as the result of the deposite of a coin which output signal is characteristic of the size and metalcontent of the coin. The differences between output signals resulting from similar coins such as the British ten pence and British fifty pence pieces is however relatively small with the known devices and it is therefore necessary to provide either relatively complex analytical circuity to distinguish between the different outputs or to have an auxiliary size monitoring device so that effectively the magnetic circuit monitors the metallic content of a deposited coin whereas its size is monitored by a separate sensor mechanism.

It is an object of the present invention to provide a coin validation device comprising a magnetic circuit which produces output signals when different coins are passed through it that are sufficiently distinct to enable ready identification of the various coins.

According to the present invention there is provided a coin validation device comprising a channel along which a coin to be validated is caused to apss, and a pair of magnetic cores located on opposite sides of the channel so that a coin to be validated will pass therebetween, wherein each core is E-shaped in a sectiontaken perpendicular to the direction in which a coin to be validated passes along the channel so as to define a central leg extending towards the other core, one central leg supporting an exciting coil and the other central leg supporting a detector coil.

In use an AC current is driven through the exciting coil and a voltage amplitude monitoring circuit is connected to the detector coil. for a constant AC supply the amplitude of the voltage provided by the detector coil varies significantly in response to relatively minor variations in the size, thickness and methal content of coins passed between the cores.

Preferably the detector coil output is converted to a DC voltage and a series of voltage comparators are arranged to detect the maximum change in the DC voltage as a coin passes between the cores. This maximum change is a measure of the characteristics of the coin.

The E-shaped cores can be of substantially the same shape and dimensions. The two cores may b e offset relative to each other in a direction perpendicular to the direction in which a coin passes between the cores, adjustment of the offset adjusting the sensitivity of the device to particular coins. Where two coins have similar characteristics the offset can be selected to maximise the ability of the device to distinguish those coins.

According to a further aspect of the invention, a coin validation mechanism comprises a channel along which a coin to be validated is caused to pass, the channel extending directly between a coin deposit slot and a reject coin return position, and means for diverting a deposited coin from the channel if and only if the coin is validated.

Thus, the mechanism defaults to reject and it is very difficult to jam the mechanism.

Embodiments of the present invention will now be described, by way of example with reference to the accompanying drawings, in which.

Figure 1:
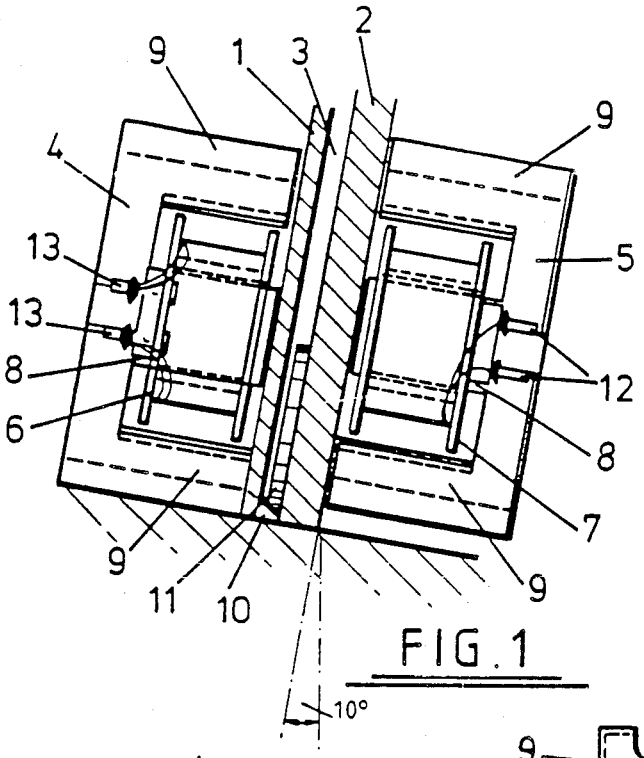
FIG. 1 is a part sectional illustration of an embodiment of the invention looking along a channel along which a deposited coin travels.

Referring to FIG. 1, the illustrated device comprises two moulded panels 1, 2 between which a slot or channel 3 is defined. A pair of E-shaped magnetic cores 4, 5 are located on opposite sides of the channel and separated therefrom by the panels 1 and 2. The panels 1 and 2 can be 2 and 4 millimetres thick for example. The cores 4 and 5 support bobbins 6 and 7 on respective central legs 8 which extend towards each other. The bobbins 6 and 7 are located inside outer legs 9 of the E-shaped cores.

The bottom of the channel 3 is closed by a surface 10 inclined to and supported on a rigid member. The surface 10 ensures that the bottom edge of an inserted coin 11 is edged towards the panel 2. In addition, the channel is inclined at approximately 10° to the vertical so that a coin 11 inserted therein leans against the side panel 2 of the channel.

Figure 2:
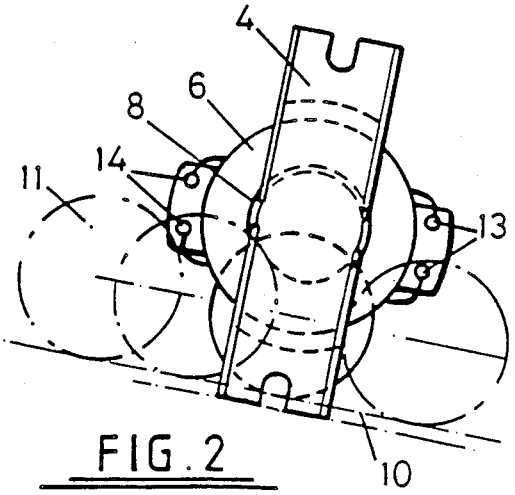
FIG. 2 illustrates the relationship between one of the magnetic components of the arrangement of FIG. 1 and a deposited coin.

Referring now to FIG. 2, a side view of the device of FIG. 1 taken on the lines 2—2 of FIG. 1 is shown. The side panel 1 is not shown in FIG. 2 but merely those components of the device which are visible on the side of panel 1 from which the view of FIG. 2 is taken.

As can be seen the runway forming the bottom edge of the channel is inclined at approximately 10° to the horizontal so taht coins inserted in the channel roll under their own weight through the channel. The series of circles shown in FIG. 2 represent the position adopted by a coin at spaced apart time intervals as it moves through the device. It will also be seen that the E-core 5 is offset relative to core 4 by a few millimetres in a direction perpendicular to the direction of travel of the coin 11. The amount of offset affects the sensitivity of the device. For example, if two coins of a set of coins have similar characteristics such that the two coins cannot be distinguished when the offset is zero, the offset can be adjusted to maximise the sensitivity of the device to the differences between those two coins.

Other coins in the set will still be adequately distinguished. The device can thus be easily adjusted to deal with different sets of coins.

Referring again to FIG. 1, the bobbin 7 supports a single detector coil connected to terminals 12. The bobbin 6 supports two coils connected to respective pairs of terminals 13 and 14 (FIG. 2).

Figure 3:
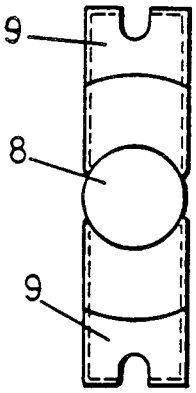
FIGS. 3 and 4 are respectively front and side veiws of an E-core as used in the arrangement of FIG. 1.
Figure 4:
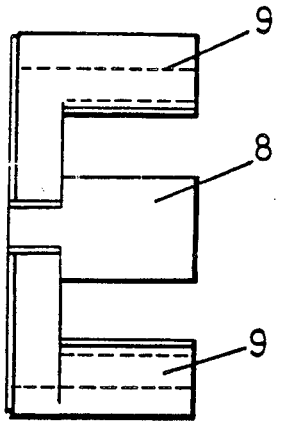

Referring now to FIGS. 3 and 4, the detailed structure of the E-cores of FIG. 1 is illustrated. The two E-cores are substantially identical.

Figure 5:
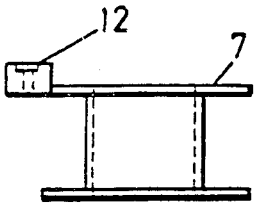
FIGS. 5 and 6 are respectively side and end views of a bobbin supported on a central leg of one E-core in the arrangement of FIG. 1.
Figure 6:
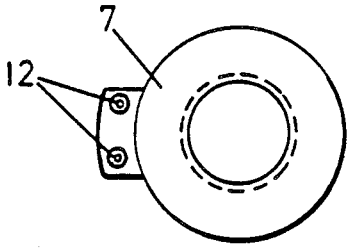
Figure 7:
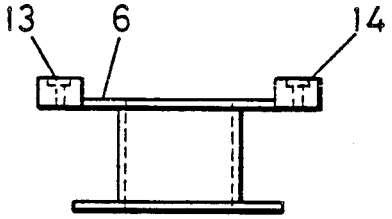
FIGS. 7 and 8 are respectively side and end views of a bobbin supported on a central leg of the other E-core of the arrangement of FIG. 1.
Figure 8:
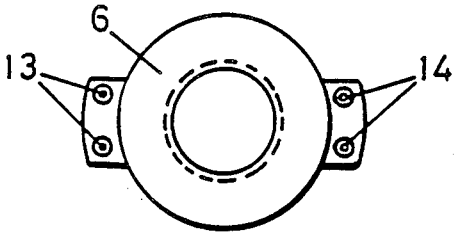

Referring now to FIGS. 5 and 6 these illustrate the bobbin 7 of FIG. 1. FIGS. 7 and 8 illustrate the bobbin 6 of FIG. 1.

Figure 9:
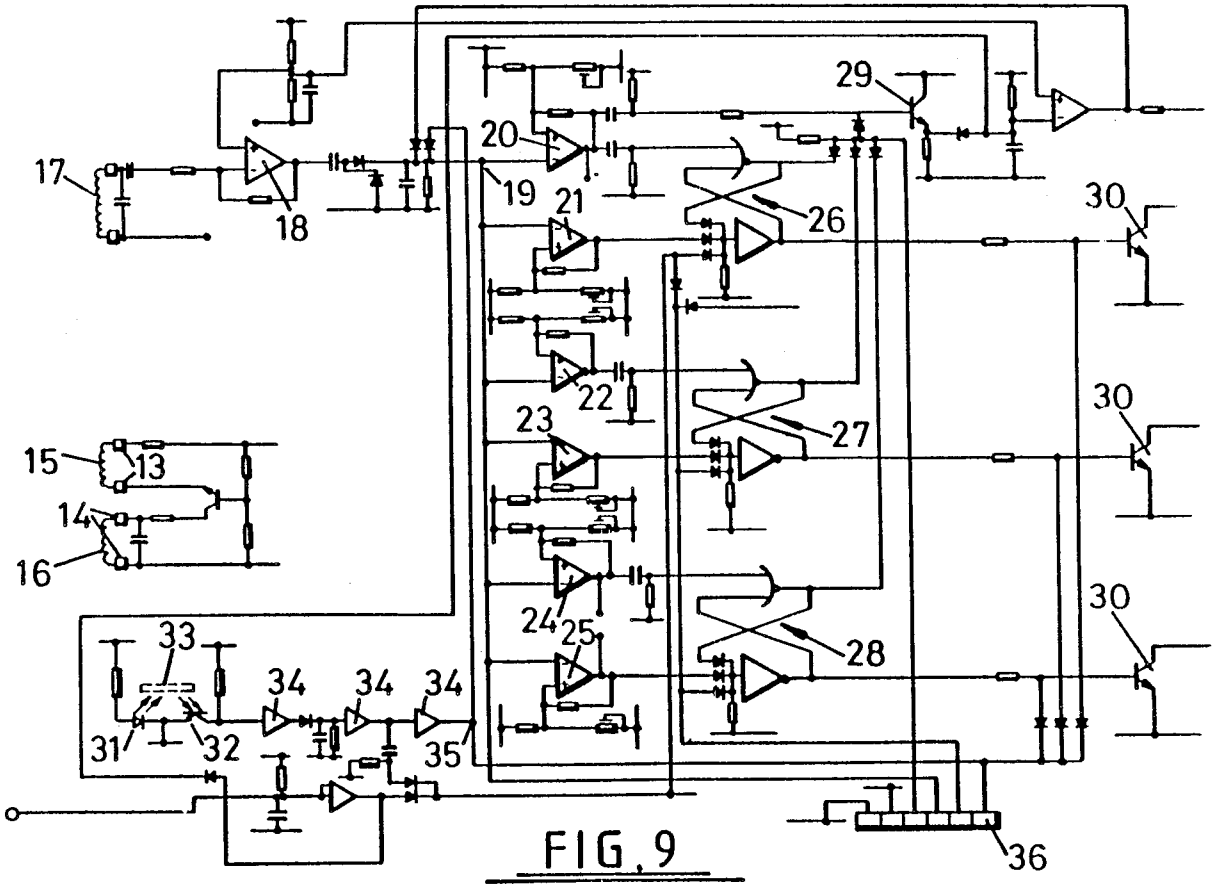
FIG. 9 is a schematic circuit diagram of circuitry for use with the device of FIG. 1.

Referring now to FIG. 9, the illustrated circuit is intended for use with the device illustrated in FIG. 1. The circuit comprises a 100 turn coil 15 which is connected between the terminals 13 of bobbin 6 (FIG. 8) and a 400 turn coil 16 which is connected between the terminals 14 of the bobbin 6. These coils are connected as shown so as to define an oscillating circuit which generates an alternating magnetic field between the legs of the E-shaped core 4. The oscillator is coupled to the rest of the circuitry magnetically through the gap defined bythe channel 3 between the two E-cores 4 and 5.

A coil 17 is connected between terminals 12 of the bobbin 7 (FIG. 6). The coil 17 is thus a detector of the magnetic field generated by the E-core 4 and the strength of that magnetic field is affected by the passage of a coin along the channel 3. The output of the detector coil 17 is delivered to an amplifier 18 which is adjusted to deliver a predetermined output voltage when the channel 3 is empty. This effectively calibrates the system.

A DC voltage appears at terminal 19, the DC voltage being representative of the strength of the magnetic field detected by the coil 17.

With the arrangement as described above the terminal 19 carries a DC voltage of approximately 6 volts when the channel is empty. when a coin passes along the channel this voltage is reduced and then rises again after the coin has moved beyond the E-cores. The magnitude of the change in the voltage at terminal 19 varies considerably as between one coin and another and accordingly it is simply necessary to measure the magnitude of the voltage change at point 19 to determine whether or not a coin deposited into the channel is a coin which is to be acceptable to the device.

In the illustrated arrangement the voltage at terminal 19 is monitored by three pairs of comparators, that is comparator pair 20 and 21, comparator pair 22 and 23 and comparator pair 24 and 25. Each comparator is in the form of an amplifier. Each pair of amplifiers controls a respective latching circuit 26, 27 and 28. The operation of each of these three amplifier pair and latch circuits is substantially the same and accordingly only that associated with amplifier pair 20 and 21 is described below.

When a coin passes between the E-cores the voltage at terminal 19 drops. If the coin is one that is to be recognised by the amplifier pair 20 and 21 the voltage drops to a level below an upper threshold set by amplifier 20 but above a lower threshold set by amplifier 21. The output of amplifier 20 sets the latch 26 but the latch is not reset by theamplifier 21 because the voltage at terminal 19 has not dropped sufficiently far. The latch 26 is then in its latched condition and turns ona transistor 29 when the output of the amplifier 20 indicates that the coin has passed the E-cores and the voltage at terminal 19 has returned to its normal level. A blocking coil effectively opens a passageway which diverts a coin from the channel inot a coin receiving device. An output transistor 30 also enables the equipment associated with the described device to perform a function appropriate to that paid for by the deposit of the validated coin.

If the voltage of terminal 19 drops beyond the lower threshold set by amplifier 21 the latch is reset and the coin is not identified as a coin of the type to which the amplifier pair 20, 21 is dedicated. It may be however that the voltage drops to a level corresponding to the voltage "window" defined by either the amplifier pair 22, 23 or the amplifier pair 24, 25 in which case the circuitry operates so as to effectively validate the deposited coin.

To guard against the possibility of a coin being validated but not being delivered to the coin storage receptacle by the blocking coil a light emitting diode 31 and photosensitive detector 32 are arranged so as to detect the passage of a coin 33 into the coin storage receptacle. The output of the photosensitive detector 32 is applied to a series of circuits 34 which deliver a pulse of predetermined width to a terminal 35. This pulse enables the output transistors 30. Without this enabling pulse even if the blocking coil fails to operate a user cannot repeatedly insert a validated coin and purchase goods as a result even if the validated coin is returned to the user after each operation.

Conventionally the blocking coil of the coin validation mechanism has been used to positively reject depositted coins only when an invalid coin is detected whereas in the present case all coins are rejected unless they are positively validated.

The light emitting diode 13 and photosensitive detector 32 are arranged as shown to detect the passage of a coin by reflecting light from the coin. This has the advantage that both of components 31 and 32 can be located on one side of the coin channel thereby simplifying the necessary wiring.

An expansion plug 36 can be provided to enable the number of voltage ranges which are to be deemed as indicating an acceptable coin to be increased. Thus, whereas the illustrated circuit can validate any one of three different coins the provision of further voltage comparator circuits substantially identical to those as illustrated enables the expansion of the system to handle four or more coins.

I claim:

1. A coin validation device comprising a channel along which a coin to be validated is caused to pass, the channel defining a first axis, and a pair of magnetic cores located on opposite sides of the channel and at the same position along the length of the channel so that a coin to be validated will pass therebetween, the cores being of substantially the same size and each being E-shaped so as to define a central leg and two outer legs extending towards the corresponding legs of the other core in a direction substantially parallel to a second axis, the central leg of one core supporting an exciting coil, and the central leg of the other core supporting a detector coil, characterized in that the channel is limited at one edge by a surface that in use is inclined to the horizontal so as to define a predetermined inclined path down which the coin is caused to roll, the outer legs of each core are spaced apart in a direction perpendicular to the length of the channel along a third axis, the first, second and third axis being mutually perpendicular, and one outer leg of each core is located adjacent the said one edge of the channel.

2. A coin validation device according to claim 1 wherein the dimensions of the cores are such that the edge of a coin rolling down the said one edge of the channel extends part-way across the facing ends of both central legs of the cores.

3. A coin validation device according to claim 1 wherein the cores are offset relative to each other in the said direction perpendicular to the length of the channel.

4. A coin validation device according to claim 1 wherein in use the channel is inclined to the horizontal such that the coin is caused to lean to one side of the channel as it rolls down the sai inclined path.

5. A coin validation device according to claim 1 comprising means for driving an AC current through the exciting coil, and means for monitoring variations in voltage induced in the detector coil.

6. A coin validation device according to claim 5 wherein the monitoring means comprises means for converting the detector coil output to a DC voltage, and a series of voltage comparators arranged to detect themaximum change in the DC voltage as a coin passes between the cores.

7. A coin validation device according to claim 1 wherein the channel extends directly between a coin deposit slot and a reject coin return position, and means are provided for diverting a deposited coin from the channel if and only if the coin is validated.

8. A coin validation mechanism according to claim 1 comprising a channel along which a coin to be validated is caused to pass, the channel extending directly between a coin deposite slot and a reject coin return position, and means for diverting a deposited coin from the channel if and only if the coin is validated.

* * * * *